United States Patent [19]

Gueret et al.

[11] 4,446,880

[45] May 8, 1984

[54] MAKE-UP BRUSH

[75] Inventors: Jean-Louis H. Gueret; Jean-Pierre Arraudeau, both of Paris, France

[73] Assignee: L'Oreal, Paris, France

[21] Appl. No.: 380,904

[22] Filed: May 21, 1982

[30] Foreign Application Priority Data

May 27, 1981 [FR] France ..... 81 10586

[51] Int. Cl.[3] ..... A45D 40/30

[52] U.S. Cl. ..... 132/88.5; 15/165; 15/212

[58] Field of Search ..... 132/88.5, 88.7; 15/227, 15/165, 212, 154, 144 R, 104.05, 104.19, 104.35, 201, 227

[56] References Cited

U.S. PATENT DOCUMENTS

| | | | |
|---|---|---|---|
| 183,293 | 10/1876 | Freese | 15/212 UX |
| 702,359 | 6/1902 | Durston | 15/165 |
| 2,180,533 | 11/1939 | Leffler | 132/88.7 |
| 3,998,235 | 12/1976 | Kingsford | 132/88.5 |

FOREIGN PATENT DOCUMENTS

| | | | |
|---|---|---|---|
| 258670 | 9/1926 | United Kingdom | 15/227 |

*Primary Examiner*—Gregory E. McNeil

*Attorney, Agent, or Firm*—Cushman, Darby & Cushman

[57] ABSTRACT

A make-up brush, in particular an eyelash brush, includes a bellows or longitudinally slit sleeve defining bristles and adapted to be varied in diameter, by variation in length, so as to suit the wishes of a user or the properties of a make-up product to be applied.

11 Claims, 5 Drawing Figures

MAKE-UP BRUSH

DESCRIPTION

FIELD OF THE INVENTION

The present invention concerns improved make-up brushes and more particularly eyelash brushes, that is to say brushes intended to apply a make-up product such as mascara to the eyelashes.

BACKGROUND OF THE INVENTION

The eyelash brushes known at present consist of a handle whose end carries the brush proper. They are generally made by means of tufts of bristles held between metal wire. Certain eyelash brushes have also been proposed in which these bristles are replaced by hook-shaped bristles of a material such as that sold under the Trade Name "VELCRO".

These brushes naturally have constant and well- defined characteristics, both as regards the disposition and distribution of the bristles in space and as regards the suppleness of hardness of the brush. Similarly, the quantity of the make-up product capable of being retained on the brush remains constant for a given make-up product. Now, the requirements of the users of these brushes may vary a very great deal. In fact, the shape, the number, the disposition and the length of the eyelashes may vary considerably from person to person, as may also their thickness and suppleness. Moreover, the make-up products currently on sale are becoming more and more numerous and have very different characteristics of colouring, viscosity etc. Finally, the make-up habits vary enormously from person to person.

The invention proposes to overcome these various problems and to supply an improved make-up brush, in particular an eyelash brush, which would be capable of being adapted to the various requirements encountered, whether these requirements are dictated by the user or related to the nature of the make-up product used. Moreover, the invention proposes to supply such a brush which could be of simple design, inexpensive, and easy to make.

SUMMARY OF THE INVENTION

The present invention provides an improved make-up brush, in particular an eyelash brush, comprising: shaft means; brush means including means regularly distributed around the longitudinal axis of the make-up brush to serve as bristles; and means actuable by the user for varying the diameter of the brush means, at least locally, at said regularly distributed bristle means.

Thus, the improved make-up brush according to the invention may adopt at least two stable states, that is to say, a small diameter state where the diametrical dimension of the brush means is minimal and a large diameter state wherein, on the contrary, this dimension is a maximum for at least a part of the length of the brush means at the bristle means.

However, in an improved mode of implementation, provision may be made for the brush to be maintained in intermediate states wherein the diametrical dimension of the brush means is intermediate between the maximum dimension and the minimum dimension.

In a first mode of implementation of the invention, the brush means carrying or having the regularly distributed bristle means, or at least a part of this brush means, is designed so as to be capable of varying its length under the effect of suitable actuation means and it is this variation of length which produces a variation in the brush diameter by deformation such that this diameter increases when the length decreases, and vice versa.

In a first embodiment of this mode of implementation, the brush means may comprise several deformable longitudinal strips distributed in the space around the longitudinal brush axis and interspaced by gaps, each strip carrying at least one row of bristles. The actuation means may then comprise a simple longitudinally movable rod, for example slideable, within the shaft, one of the ends of this rod forming or comprising an actuation element while the other end is connected to one end of the said strips whose other end is fixed in relation to the shaft. Thus by displacing the rod longitudinally in relation to the shaft, a shortening or an extension of the distance separating the ends of the strips carrying the bristles, and therefore a deformation resulting in variation in the diameter of the strips, is produced. The variations are most pronounced around the central portion of the strips which, because of this, assume a domed shape when they are in their maximum diameter state. The strips may advantageously be strips made of a synthetic or elastomeric material, the bristle extending preferably integrally from the strip and being made, for example, together with the latter by injection moulding.

By way of example a hollow sleeve, of a generally cylindrical shape, may thus be moulded of an elastomer and provided with bristles set up perpendicularly to the sleeve surface, preferably in the form of regular rows; after moulding, longitudinal gaps are cut into the sleeve to define the longitudinal strips of the sleeve, the gaps preferably not extending up to the ends of the sleeve.

It is thus possible to obtain at one and the same time a very important variation in diameter at the level of the central zone of the strips and, simultaneously, a variation in the suppleness of the brush.

In a second embodiment, the brush means comprises a bellows provided with successive notches and fins to form a kind of indentation so that the regularly distributed means serving as bristles are formed by the annular teeth of the identations constituted by the bellows.

Advantageously, the bellows has one of its own ends mounted at the end of the shaft and is fixed by its other end to the end of an actuator rod capable of being displaced between a sunken position in the shaft, wherein the bellows is elongated and has a reduced diameter, and a position which is partly extracted from the shaft, wherein the bellows is shortened and its diameter increased.

Preferably, the fixing of the bellows both at the end nearer the handle and at the other end to the rod is obtained by catch engagement.

This embodiment makes it possible, in particular, to cause the height of the teeth and the average space separating the teeth to vary, which correspondingly allows variation of both the quantity of the make-up product contained on the brush and the conditions of wiping the eyelashes.

In another mode of implementation, the regularly distributed bristle means may be mounted on sectors or longitudinal elements, for example strips carrying rows of bristles, these sectors being capable of being brought towards or moved away from the geometric brush axis, for instance, by means of a wedging device actuated by a suitable actuator rod.

In another mode of implementation, the regularly distributed bristle means may be carried by an elastomer sleeve which is capable of expanding its diameter, the sleeve being mounted on a diameter variation device, for example one of the wedging type.

BRIEF DESCRIPTION OF THE DRAWINGS

Other advantages and characteristics of the invention will emerge on reading the following description made by way of a non-restrictive example and referring to the attached drawing wherein.

PREFERRED EMBODIMENTS OF THE INVENTION

Figure 1:
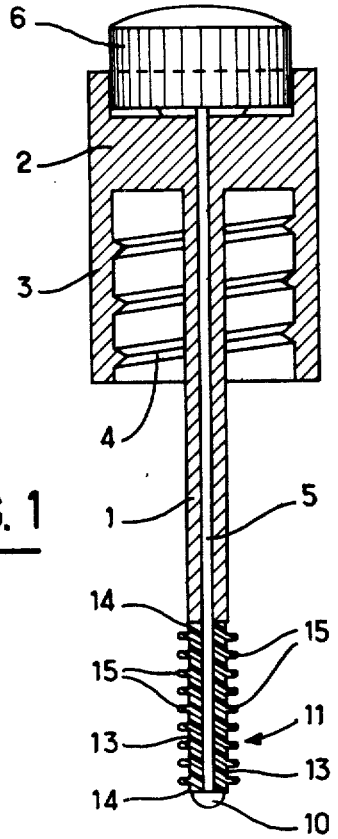
FIG. 1 shows a longitudinal cross-sectional view of a first embodiment of an eyelash brush according to the invention, in its minimum diameter state.
Figure 2:
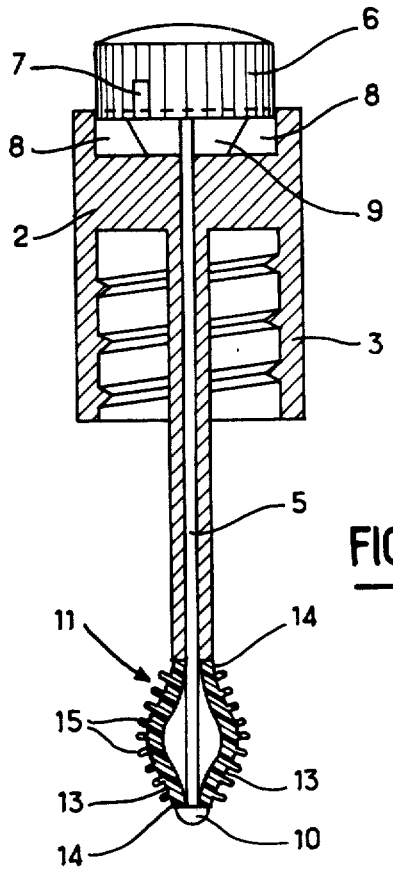
FIG. 2 shows this brush in its maximum diameter state.
Figure 3:
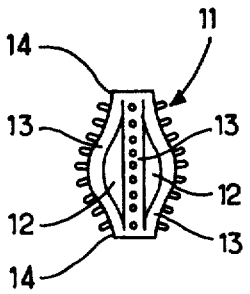
FIG. 3 shows the brush proper, in the state shown in FIG. 2.

Reference will first be made to FIGS. 1 to 3.

The eyelash brush according to the invention comprises an elongated tubular shaft 1 whose end is fixed in the usual way to a part 2 forming the closure of a container (not shown) for the eyelash make-up product. This closure part 2, which is of an enlarged diameter, has a skirt 3 provided with internal threads 4 for screwing closure part 2 on to the container neck. This closure part 2 also serves as a holding element for the user.

The tubular shaft 1 slideably encloses an elongate rod 5 whose top end is fixed to a button 6 having a suitably striated peripheral edge to facilitate gripping by the user. This button is movable between a high position as in FIG. 2, and a low position as in FIG. 1, and may be retained in these extreme positions thanks to slots 7 which are capable of cooperating with inner ribs 8 disposed within a recess 9 in the top of closure part 2. If button 6 is rotated around the longitudinal axis of rod 5, so as to align slots 7 with ribs 8, the ribs 8 may be dropped into the slots 7 and button 6 can thus come nearer to the rest of closure part 2, as shown in FIG. 1. If, on the other hand, the slots 7 are angularly offset relative to the ribs 8, the base of button 6 rests on the tops of ribs 8 and button 6 is thus found in its position remote from closure part 2, as shown in FIG. 2.

It will moreover be seen that the end 10 of rod 5 is rounded, for instance in the manner of a rivet head, and of diameter considerably greater than that of rod 5 and substantially the same as that of the end of tubular shaft 1 so that an elastomer sleeve may be disposed between these two ends to form the brush proper (generally designated 11). This sleeve, obtained for instance by injection moulding, has a hollowed out central part allowing the rod 5 to pass therethrough and has been moulded in the configuration shown in FIG. 1. It has, in fact, a generally cylindrical shape and comprises four radial gaps or slits whose length is shorter than the length of the sleeve so that these radial gaps or slits define four longitudinal strips 13 on the sleeve which are not interconnected except at the ends 14 of the sleeve. Each strip 13 has one or several rows of bristles or supple stumps 15 forming the bristles of the brush.

In the FIG. 1 configuration, the distance between the rounded end 10 of the rod 5 and the end of shaft 1 is practically equal to the length of sleeve 11 in its released state.

If, starting from this state, button 6 is pulled upwards to bring it into the FIG. 2 position, the distance between end 10 and the end of shaft 1 is shortened so that the various strips 13 of sleeve 11 become deformed outwardly by buckling, thus producing a pronounced increase in the brush diameter, this increase being at its maximum approximately midway along the sleeve. It will thus be understood that the brush may be used by a person either in the minimum diameter configuration shown in FIG. 1, or in the maximum diameter configuration shown in FIG. 2 wherein the button 6 has been rotated around its axis to ensure that the configuration is maintained. If the user wishes to return from the FIG. 2 position to that of FIG. 1, she only has to align the slots 7 with the ribs 8 and then the rod 5 moves downwards under the effect of the elastic force of the deformed sleeve 11 which tends to resume its elongated released position having the reduced diameter of FIG. 1.

By suitably determining the nature and thickness of the sleeve 11, different degrees of suppleness and user comfort may be obtained; this suppleness moreover varies according as to whether one is in the position of FIG. 1 or that of FIG. 2.

This embodiment may, of course, be subject to many variations. Thus, the number of strips may be higher than four, for instance, six or eight. The shape and disposition of the bristles can obviously be altogether different. The actuating mechanism may also vary according to all forms within the skill of the expert designing the brush. Finally, instead of being connected at their ends, the strips could be completely independent by being then connected, by suitable means, to the rod on the one hand and to the shaft on the other hand.

Figure 4:
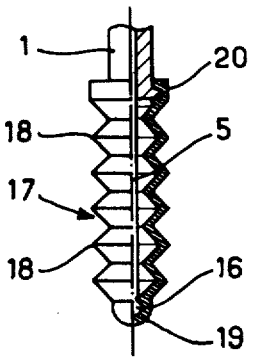
FIG. 4, showing the brush proper in its minimum diameter state, is a longitudinal half section of a brush according to a second embodiment of the invention.
Figure 5:
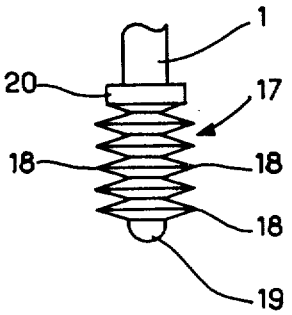
FIG. 5 shows this brush in its maximum diameter state.

Reference will now be made to FIGS. 4 and 5.

In this embodiment, the shaft 1 and rod 5 slideable therewithin are retained. However, in this case the rod 5 is extended in a spherical end 16 which is preceded by a notch. The brush proper is constituted by a flexible bellows 17 forming successive annular teeth 18. The bottom rounded end 19 bounded by this bellows 17 has a small internal lip capable of coming into the notch between the end of rod 16 and the body of rod 5 for the purpose of fixing, by catch engagement, between the spherical end 16 and rod 5. At its open other end 20, the bellows also has a notch capable of allowing the fixing by catch engagement of the bellows end 20 against the lower end of hollow shaft 1, and is for this purpose provided with a small catch engagement bead capable of penetrating within this notch.

It will therefore be seen that since the bellows 17 is fixed, on the one hand, to the end of shaft 1 and, on the other hand, to the rod end 16 a rising motion of rod 5 produces a shortening of the bellows 17 and therefore an increase in the diameter of the tips of teeth 18 as well as of the depth of the notch separating two successive teeth 18. Moreover, a variation in suppleness of the bellows may be produced in this way.

Preferably, the bellows has sufficient elasticity to cause it to resume the elongated reduced diameter portion of FIG. 4 so that such a bellows 17 can be mounted on a device similar to that of FIGS. 1 and 2 with the same means of actuation.

Although the invention has been described with reference to special embodiments, it shall be duly understood that it is in no way limited thereto and that various modifications of shape and materials may be brought thereto without thereby departing either from the scope or spirit of the invention.

We claim

1. In a make-up brush having a longitudinal axis and comprising:

(a) shaft means; and (b) brush means having first and second ends and including means regularly distributed around said longitudinal axis of the brush to serve as bristles; the improvement comprising (c) means actuable by a user of the make-up brush for varying the brush diameter at least locally at said regularly distributed means thereof.

2. A make-up brush according to claim 1, wherein said brush means is adapted to undergo deformation to vary in length so as to produce an increase in diameter simultaneous with decrease in length and vice versa.

3. A make-up brush according to claim 1, wherein the shaft is integral with means defining a closure for a make-up product container.

4. A make-up brush according to claim 2, wherein said brush means comprises several deformable longitudinal strips distributed around the longitudinal axis of the brush and separated from each other by gap means and wherein each said strip carries at least one row of bristles constituting said regularly distributed means.

5. A make-up brush according to claim 4, wherein said strips define a moulded sleeve with said gap means stopping short of first and second ends of the brush means; said strips being joined together at said first and second ends.

6. A make-up brush according to claim 3, wherein said brush means diameter varying means comprises actuation means capable of producing variation in length of said brush means.

7. A make-up brush according to claim 6, wherein said shaft means comprise a hollow shaft having first and second ends, and a rod sliding within said hollow shaft and having an end adapted to entrain said first end of said brush means, said second end being immobilised by said first end of said hollow shaft, and wherein said actuation means is effective to slide said rod along said hollow shaft.

8. A make-up brush according to claim 7, wherein said brush means is disposed between said first end of said hollow shaft and said end of the rod so as to be elastically compressed and deformed when said end of the rod is brought towards said first end of the hollow shaft.

9. A make-up brush according to claim 7, wherein said actuating means comprise a button means integral with said rod, and means allowing said rod to be maintained in alternative desired positions.

10. A make-up brush according to claim 8, wherein said actuating means comprise a button means integral with said rod, and means allowing said rod to be maintained in alternative desired positions.

11. A make-up brush having a longitudinal axis and comprising (a) brush means having first and second ends and comprising a plurality of deformable longitudinal strips distributed around the longitudinal axis of said make-up brush and separated from each other by gap means, each said strip carrying at least one row of bristles, said brush means being adapted to undergo deformation to vary in length so as to produce an increase in diameter simultaneous with a decrease in length and vice versa;

(b) hollow shaft means having first and second ends and a rod slidable within said hollow shaft, said rod having an end adapted to entrain said first end of said brush means, said second end of said brush means being immobilized by said first end of said hollow shaft whereby said brush means is disposed between said first end of said hollow shaft and said rod end so as to be elastically compressed and deformed when said rod end is brought towards said first end of said hollow shaft; and (c) actuation means capable of producing variation in length of said brush means comprising button means integral with said rod and means allowing said rod to be maintained in alternative desired positions.

* * * * *